US005302054A

United States Patent [19]

Winkler et al.

[11] Patent Number: 5,302,054

[45] Date of Patent: Apr. 12, 1994

[54] HOLE SHORING SYSTEM

[75] Inventors: W. E. Winkler, P.O. Box 386, Mt. Airy, Md. 21771; Nicholas J. A. White, Damascus, Md.

[73] Assignee: W. E. Winkler, Mt. Airy, Md.

[21] Appl. No.: 948,643

[22] Filed: Sep. 23, 1992

[51] Int. Cl.[5] ..... E21D 5/12

[52] U.S. Cl. ..... 405/274; 405/272; 405/282

[58] Field of Search ..... 405/282, 283, 272, 273, 405/274, 278, 280

[56] References Cited

U.S. PATENT DOCUMENTS

| | | | |
|---|---|---|---|
| 3,727,413 | 4/1973 | Christen . | |
| 3,782,125 | 1/1974 | Holl . | |
| 3,910,053 | 10/1975 | Krings . | |
| 3,937,026 | 2/1976 | Krings . | |
| 4,054,033 | 10/1977 | Pillosio . | |
| 4,094,156 | 6/1978 | Dumont . | |
| 4,145,891 | 3/1979 | Krings . | |
| 4,274,763 | 6/1981 | Krings . | |
| 4,345,857 | 8/1982 | Krings . | |
| 4,372,709 | 2/1983 | Krings . | |
| 4,421,440 | 12/1983 | Scheepers . | |
| 4,657,442 | 4/1987 | Krings | 405/272 X |

FOREIGN PATENT DOCUMENTS

| | | | |
|---|---|---|---|
| 3906559 | 9/1989 | Fed. Rep. of Germany | 405/273 |

*Primary Examiner*—Dennis L. Taylor

*Attorney, Agent, or Firm*—Jones, Tullar & Cooper

[57] ABSTRACT

An excavation hole shoring system is disclosed which employs a plurality of shoring panels positioned between adjacent vertical soldier beams around the periphery of an excavation hole. A plurality of horizontal reinforcing members form a box frame around the hole's periphery at grade level, and each of the soldier beams is attached to an adjacent one of the reinforcing members with a metal strap. Each of the soldier beams includes a pair of longitudinal guide beams which form front and back channels for reception of front and back shoring panels. The front shoring panel is employed to shore the lower portion of an excavation hole, while the back shoring panel is employed to shore the upper portion of the hole. The two panels are therefore vertically staggered in an overlapping fashion so that holes of varying depths can be shored with the same shoring system. The shoring system is put in place progressively as the excavation proceeds, and no workers are required to enter the excavation during the installation of the system. When this work is completed, the shoring system can be quickly and easily removed during back filling of the excavation hole.

8 Claims, 6 Drawing Sheets

FIG. 1A
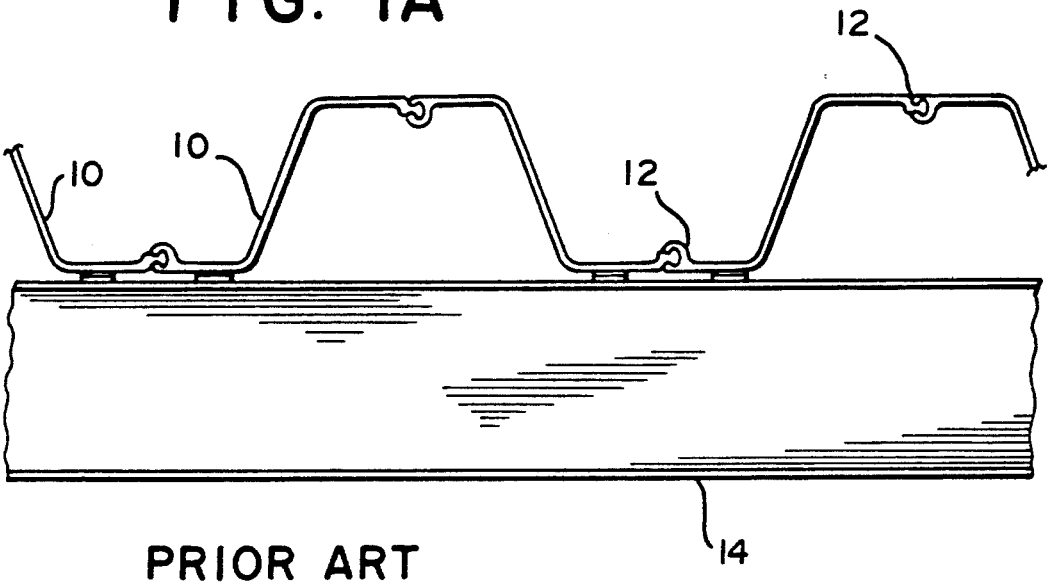
PRIOR ART
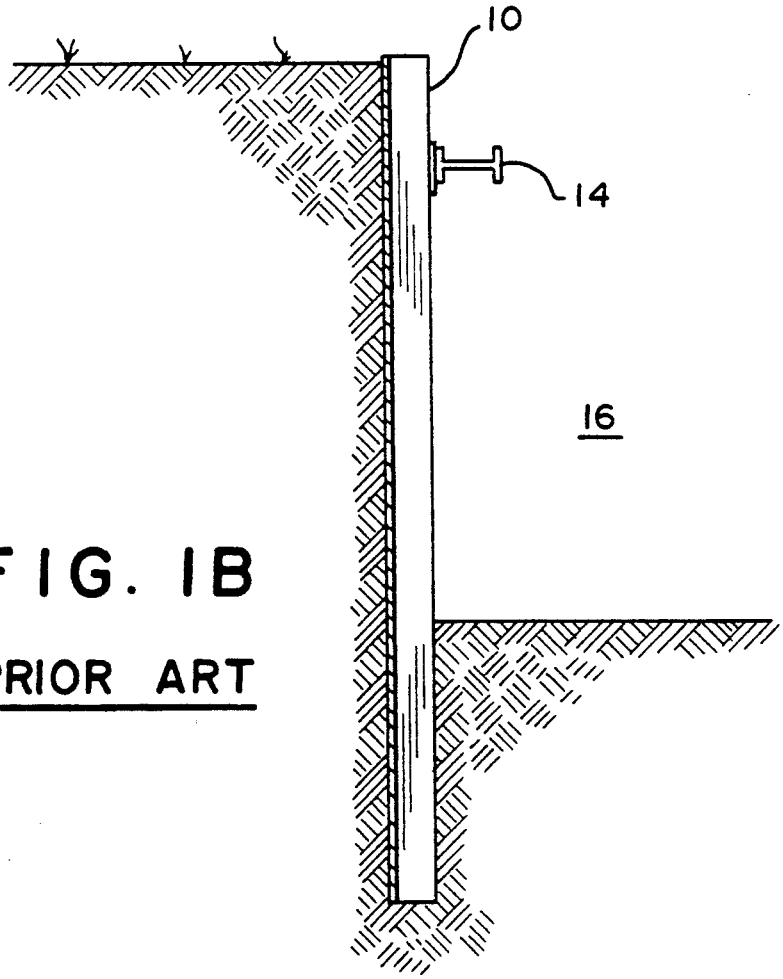
FIG. 1B
PRIOR ART

HOLE SHORING SYSTEM

BACKGROUND OF THE INVENTION

The present invention relates in general to a system for temporarily shoring the walls of excavation holes which can be easily and quickly installed and removed.

There are many times on construction projects when a hole needs to be excavated to make room for new underground facilities, such as underground storage tanks, etc. The vast majority of the time safety regulations issued by groups, such as OSHA (Occupational Safety and Health Authority), require that excavated holes be shored to prevent their sides from caving in. Upon completion of work within the excavation, the shoring is either removed or abandoned in place. Since the new facility usually supports the permanent earth pressure, the shoring therefore only serves a temporary purpose during construction.

Obviously, to meet OSHA regulations, any shoring must be properly designed and constructed. There are two principle known shoring methods which are considered sufficient to meet OSHA standards. The first of these methods is illustrated in FIGS. 1A and 1B and employs a plurality of vertically disposed steel sheet piles 10 which are connected to one another using ball and socket interconnects as illustrated at 12. As illustrated, the steel sheet piles are typically Z-shaped steel pieces and are driven into the ground before a hole 16 is excavated. An impact or vibratory type hammer is employed for this purpose, and each of the sheets must be driven down incrementally until they are fully in the ground. A typical hole requires many pieces of the sheet piles 10, and the installation process is very slow. In addition, for deep holes, a plurality of horizontal reinforcing members 24, otherwise known as walers, must be attached to the steel sheet piles 10 on the hole facing sides thereof to provide addition support to resist the earth pressure.

The sheet pile shoring method illustrated in FIGS. 1A and 1B is normally used where extremely soft or runny soils are encountered, or where the ground water level is very high. Although sheet piles are not water tight, they do help diminish the flow of water into the excavation. However, sheet piles are very difficult or even impossible to install in dense soils. Further, they are expensive and time consuming to install when used as temporary shoring and are normally extracted upon completion of the underground construction due to the relatively high material cost. This shoring method is actually best suited for permanent shoring, such as in bulk heads along waterfront areas.

A second known shoring method is illustrated in FIGS. 2A and 2B. In this method, a plurality of vertical steel I-beams 20, otherwise known as soldier piles, are installed into the ground in a spaced manner around the perimeter of a hole 22 to be shored. Typically, the soldier piles 20 are spaced about six to eight feet on center and are either driven into the ground or set into pre-drilled holes. As the hole 22 is excavated, a plurality of three to four inch thick wood timbers 24, otherwise known as lagging, is placed behind the front flanges 26 of the I-beams 20, and holds the soil in place between the I-beams 20. As with the sheet pile method, walers 28 and/or bracing are commonly used to provide additional support of the earth pressure behind the soldier piles 20.

The soldier pile and lagging method is normally used in competent soils which allow a minor temporary undercut to facilitate lagging placement. The piles can be pre-drilled to eliminate vibration or noise concerns in many cases. Further, they can penetrate very dense soils where sheet piles cannot, although they are not used in very soft or runny soils or in high ground water conditions.

Due to the relatively low cost of materials involved with this method, the soldier piles and wood lagging are preferably abandoned in place once the construction project is finished. However, the process of pre-digging to place lagging usually results in voids behind the lagging. Further, the lagging is installed with spacer blocks to prohibit buildup of water pressure against the shoring, and this allows for loss of soil between the lagging. There is also concern that as the timber lagging decomposes over time, a void will be left in its place. It is therefore very common to have minor settlement of the ground around abandoned lagging and as a result, many areas prohibit leaving lagging in the ground. Unfortunately, the subsequent removal of the lagging upon completion of the underground construction is extremely difficult, costly and dangerous.

In view of the above drawbacks of conventional hole shoring techniques, and as OSHA and other safety related groups continue to increase both enforcement of hole shoring safety standards and fines for violation of the standards, a great need has developed for an improved shoring system which eliminates the drawbacks of the two previously discussed shoring methods.

SUMMARY OF THE INVENTION

Accordingly, it is the object of the present invention to provide a hole shoring system which can be quickly and easily installed during excavation of a hole and removed after completion of construction work in the hole, and which can be safely employed in all types of soil conditions.

This and other objects of the present invention are achieved through provision of a hole shoring system, which like that of the soldier pile and wood lagging method, employs a plurality of spaced vertical soldier beams disposed in preferably pre-drilled holes around the perimeter of a hole to be excavated. Instead of wood lagging, however, a plurality of steel plates are positioned between adjacent soldier beams which support the pressure of the earth at the sides of the hole.

An important feature of the invention is that horizontal reinforcing members or walers, are installed around the top perimeter of the excavation site on the back flanges of the soldier piles facing away from the site. By positioning the walers behind the soldier piles instead of in front of them as in the soldier pile and lagging method, the excavation process can be made simpler and safer, since the walers are installed prior to any excavation, and it is not required that any construction workers enter the excavation hole to secure them.

In the preferred embodiment of the present invention, the walers are attached to each of the soldier beams by means of metal strapping which is bolted to the walers and passes through slots formed on the back flange of each soldier beam by means of a connector box welded thereto. This attachment method requires no on-site welding which not only saves time, but increases safety, especially when the excavation area is contaminated by flammable liquids, such as oil or gasoline.

Another important feature of the present invention resides in the use of a double steel panel arrangement in which two steel reinforcement panels are disposed between each pair of adjacent soldier beams. This arrangement provides versatility in that the same shoring system can be reused over and over to shore holes of different sizes and depths. With the two panel arrangement, the back panel shores the upper portion of the hole, while the front panel shores the lower portion of the hole. This arrangement enables holes having depths up to twice the height of each panel to be shored with the same shoring system by simply varying the amount of overlap between the front and back panels.

A modification is made to each of the steel soldier beams to facilitate guiding of the front and back shoring panels. In particular, smaller steel I-beams are welded on opposite sides of each soldier beam which act as guide beams and form two channels, one for the front panels and one for the back panels.

Each of the steel shoring panels has a pair of eyelets welded on the top sides thereof which facilitate insertion and removal of the plates by means of a crane or other hoisting device. This aids in placement and removal of the panels and completely eliminates the intense labor associated with the installation of wood lagging. The panels further include a bottom cutting blade and a striker bar top surface, both of which facilitate insertion of the panels as the excavation of the hole proceeds.

BRIEF DESCRIPTION OF THE DRAWINGS

The foregoing and additional objects, features and advantages of the present invention will become apparent from the following detailed description of a preferred embodiment thereof, taken in conjunction with the accompanying drawings in which:

FIGS. 1A and 1B are plan and partial side cross sectional views, respectively, of a first prior art hole shoring method;

DETAILED DESCRIPTION OF THE PREFERRED EMBODIMENTS

Figure 2A:
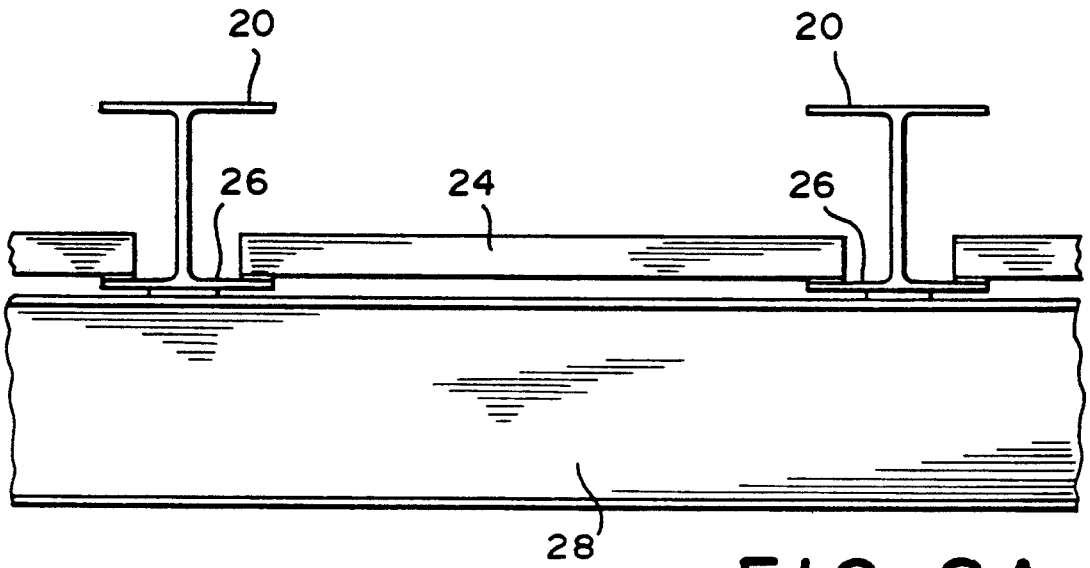
PRIOR ART FIG. 2A
FIGS. 2A and 2B are plan and partial side cross sectional views, respectively, of a second prior art hole shoring method.
Figure 2B:
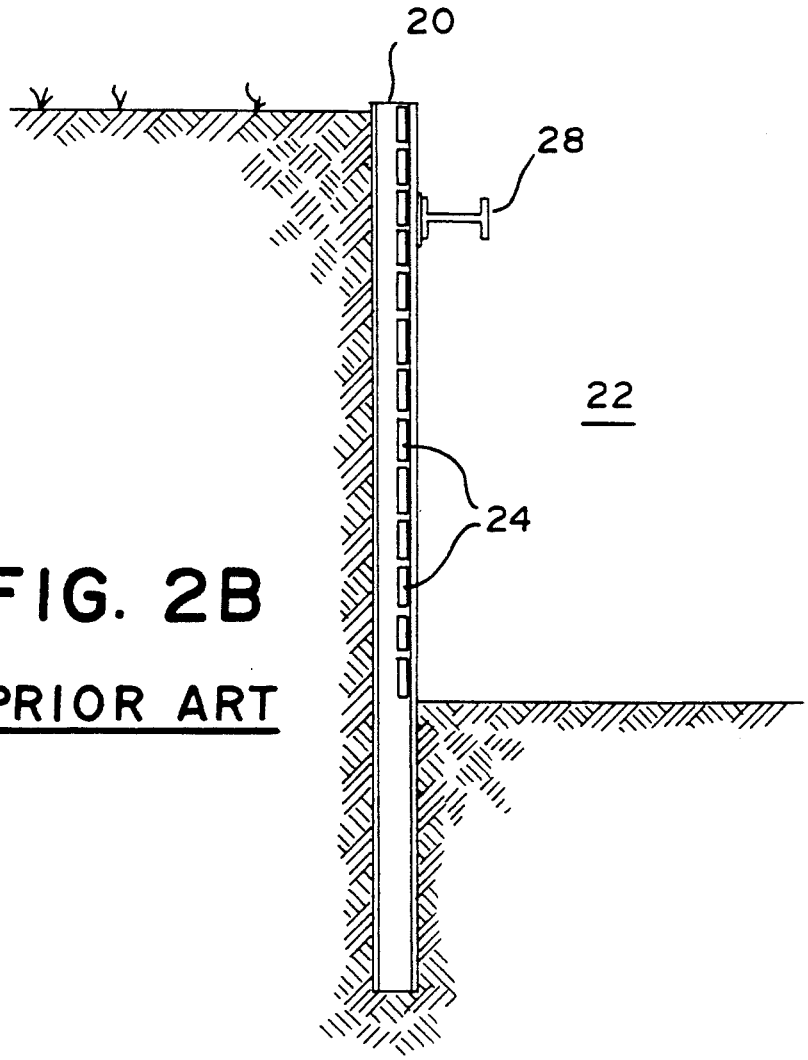
FIG. 2B PRIOR ART
Figure 3:
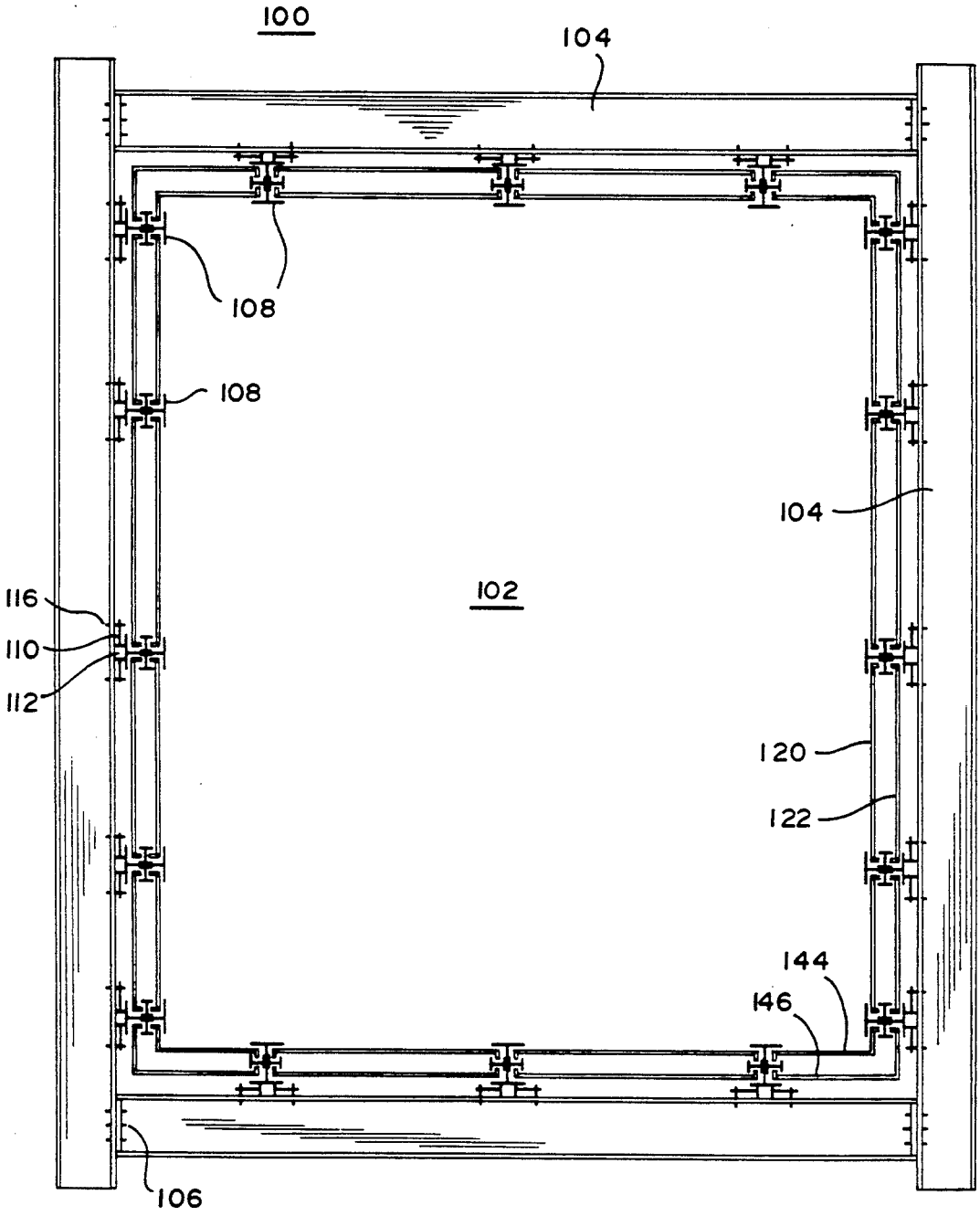
FIG. 3 is a schematic top plan view illustrating a hole shored with a shoring system that forms the preferred embodiment of the present invention.
Figure 4:
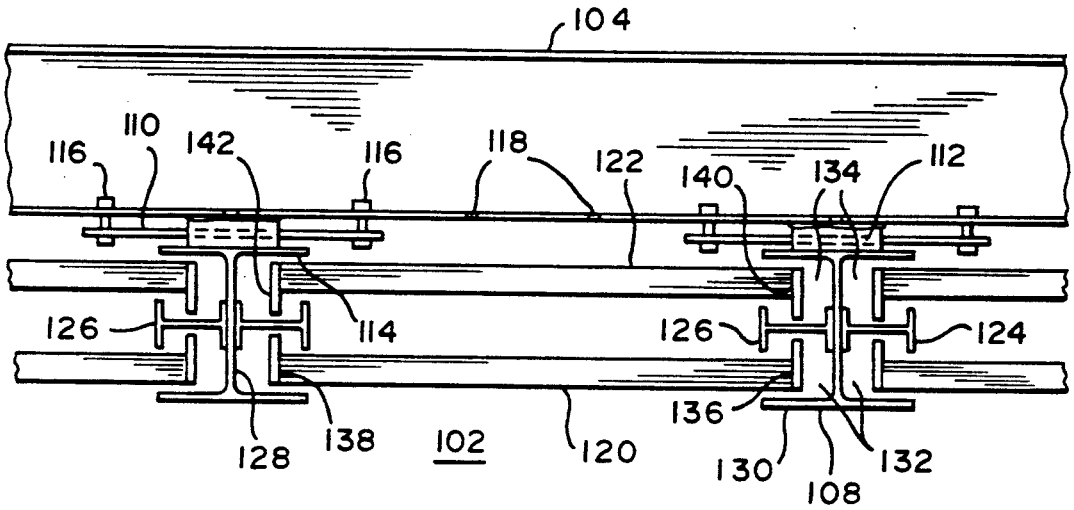
FIG. 4 is a partial section of an enlargement of FIG. 3.
Figure 5:
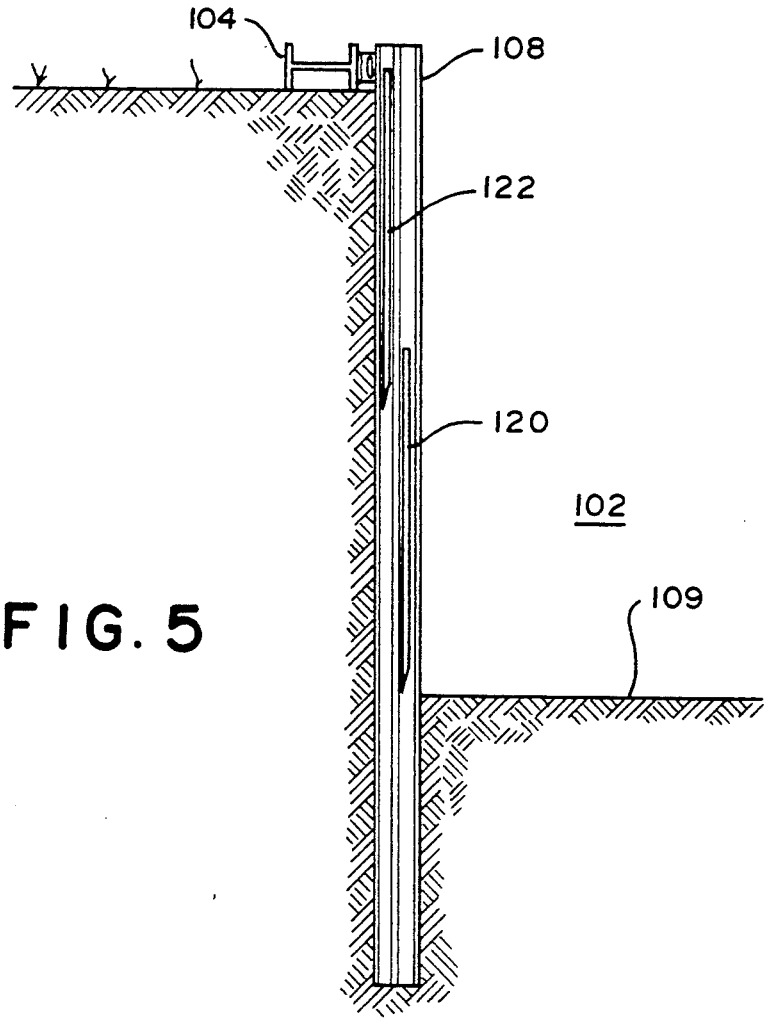
FIG. 5 is a partial side cross sectional view of the shoring system of FIG. 3.

Turning now to a more detailed consideration of a preferred embodiment of the present invention, FIGS. 3–5 illustrate a shoring system 100 installed to shore the peripheral side walls of an excavation hole 102. The shoring system 100 includes a plurality of horizontal reinforcement beams 104, otherwise known as walers, which are disposed parallel to the side walls of the hole 102 around its perimeter at the existing grade level. A plurality of nut and bolt fasteners 106 secure each of the walers 104 to one another to form a box-type frame around the excavation hole 102.

A plurality of spaced vertical soldier beams 108, which are preferably steel I-beams, are disposed in the hole 102 along its side walls adjacent the walers 104. As illustrated in FIG. 5, the soldier beams 108 are inserted into the ground to a depth substantially below a bottom 109 of the hole 102.

As illustrated in FIG. 4, the walers 104 provide reinforcement to the soldier beams 108, and each of the soldier beams 108 is attached to an adjacent one of the walers 104 by means of a metal strap 110 and a connector box 112. The connector box 112 is welded to a back flange 114 of each soldier beam 108, and the metal strap 110 passes through an opening formed therein. A pair of nut and bolt fasteners 116 secure each end of the metal strap 110 to the waler 104 through a plurality of holes 118 disposed therein.

A plurality of front flat steel shoring panels 120 and back flat steel shoring panels 122 are disposed, one each, between each pair of adjacent soldier beams 108 for shoring the side walls of the hole 102. As illustrated in FIG. 4, a pair of longitudinal guide beams 124 and 126 are welded, one each, along opposite sides of a web portion 128 of each soldier beam 108. These cooperate with the back flange 114 and a front flange 130 to form a front channel 132 and a back channel 134 along the length of each soldier beam 108 on both sides of its web portion 128.

Each of the front shoring panels 120 includes first and second flanged side ends 136 and 138 which are received in the front channels 132 of adjacent I-beams 108 for securing the front shoring panels in place. Similarly, each of the back shoring panels 122 includes first and second flanged side ends 140 and 142 which are received in the back channels 134 of adjacent soldier beams 108.

For shoring the corners of the hole 102, special L-shaped shoring panels are employed to avoid the need in the corners for special soldier beams constructed to receive shoring panels that are perpendicular to one another. Therefore, as illustrated in FIG. 3, none of the soldier beams 108 are positioned at the corners of the hole 102 and instead, a front L-shaped steel shoring panel 144 and a back L-shaped steel shoring panel 146 are disposed between each pair of the soldier beams 108 adjacent the four corners of the hole 102.

As illustrated in FIG. 5, the front and back shoring panels shore the excavation hole 102 in an overlapping manner, with the front shoring panels 120 or 144 shoring the lower portion of the hole 102 and the back shoring panels 122 o 146 shoring the upper portion of the hole 102. The manner in which the various shoring panels are installed during the excavation process is discussed in greater detail below in conjunction with FIGS. 7A and 7B.

Figures 6A, 6B:
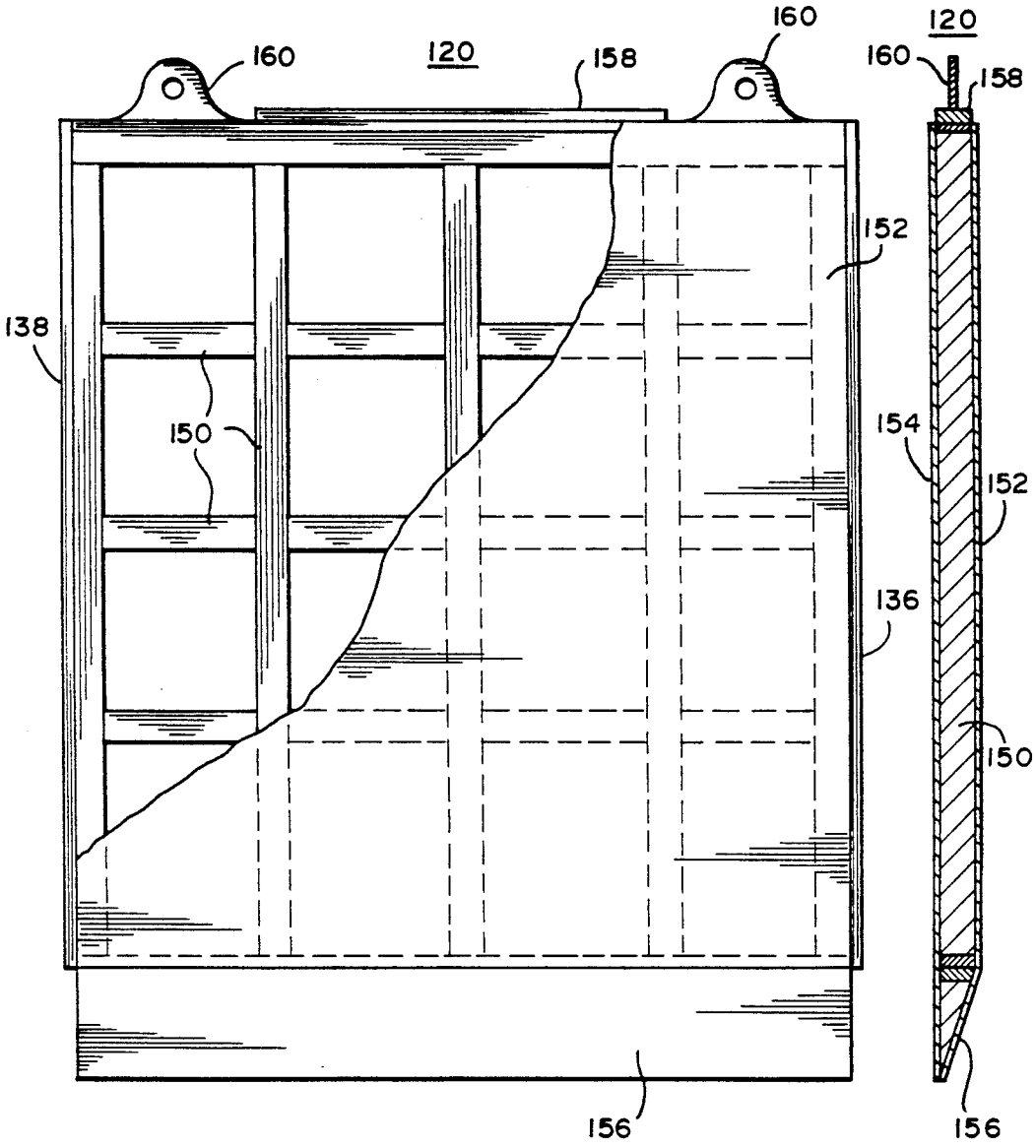
FIGS. 6A and 6B are front and side cross sectional views, respectively, of a shoring panel which is employed with the preferred embodiment of the present invention, with FIG. 6A being partially cut-away.

Turning now to FIGS. 6A and 6B, a detailed construction of one of the flat shoring panels 120 is illustrated. In particular, the panel 120 includes a steel box frame 150. First and second steel plates 152 and 154 are spot welded to front and back sides, respectively, of the box frame 150. The first and second side end flanges 136 and 138 are welded to the opposite side ends of the box frame 150. Welded to the bottom of the box frame 150 is a angled cutting blade 156 which permits the shoring panel 120 to be driven into the ground more easily.

A striker bar 158 forms the top surface of the shoring panel 120 which provides a striking surface for an impact tool to drive the shoring panel 120 into the ground. A pair of spaced steel eyelets 160 are also welded at the top of the shoring panel 120 to enable it to be hoisted by a crane or other handling implement.

It will be understood that the construction of the L-shaped shoring panels 144 and 146 is essentially the same as that of the flat shoring panels 120 and 122 with the exception that the box frame is made L-shaped, and a total of four steel plates are spot welded to the resulting four major surfaces of the frame.

Figure 7A:
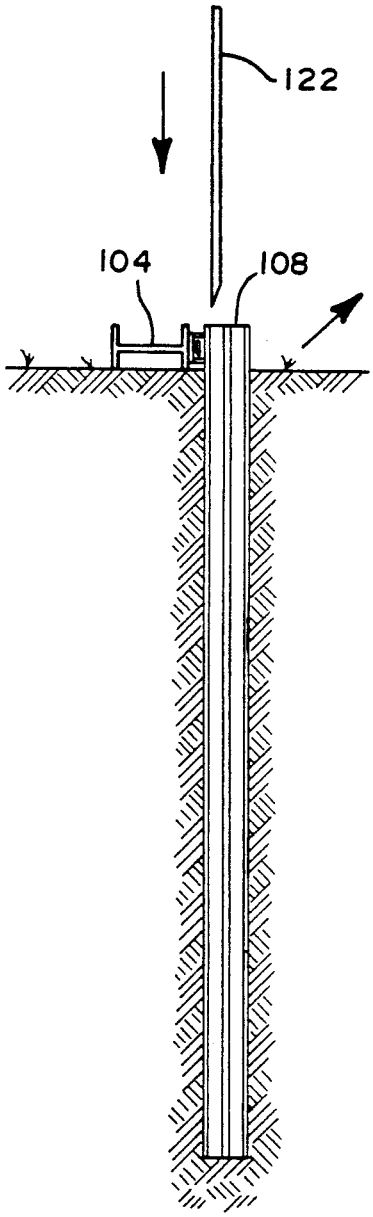
FIGS. 7A and 7B are schematic partial side cross sectional views illustrating the installation process for shoring panels during excavation of a hole.
Figure 7B:
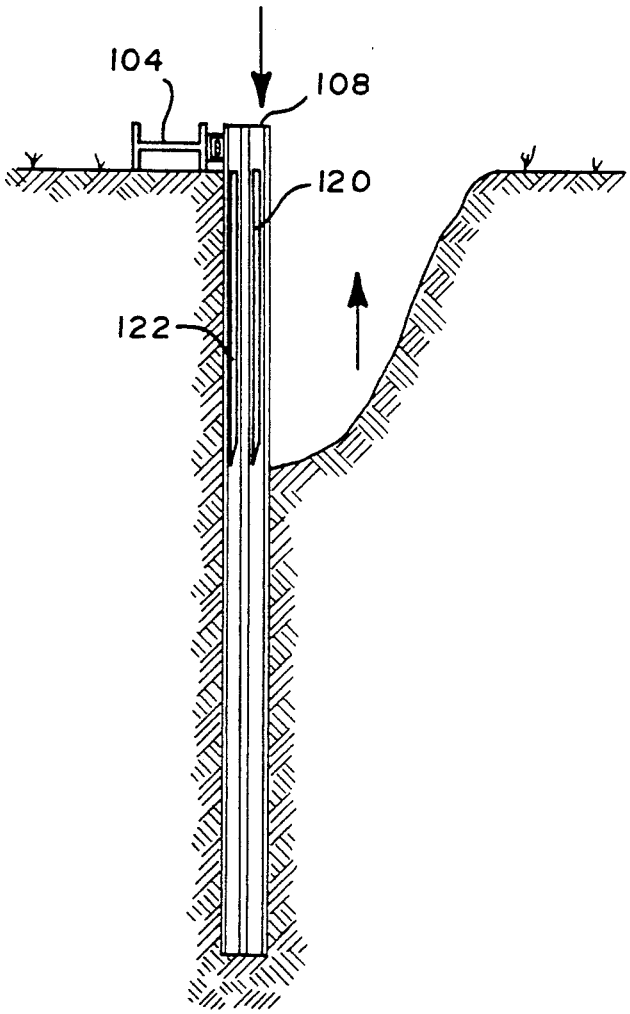

Turning now to FIGS. 7A and 7B, the process by which the various front and back shoring panels 120 or 144 and 122 or 146, are installed during excavation is illustrated. First, before any excavation is done, the walers 104 are positioned and secured around the perimeter of the excavation site. Preferably then, vertical holes are drilled in the ground for each of the soldier beams 108, although the beams can also be inserted without pre-drilled holes by driving them into the ground with an impact tool. Once the soldier beams 108 are inserted in the ground, they are secured to the walers 104 with the metal straps 110 as illustrated in FIG. 4.

The excavation of the hole now begins and at the same time, the back shoring panels 122 or 146 are driven into the ground as illustrated in FIG. 7A. Once the excavation has reached the maximum depth which the back shoring panel 122 or 146 can shore, the front shoring panel 120 or 144 is inserted as illustrated in FIG. 7B, and the excavation of the hole continues as the front shoring panel 120 or 144 is driven into the ground. Once the excavation is completed, the front and back shoring panels 120 or 144 and 122 or 146 are positioned in an overlapping vertically staggered manner as illustrated in FIG. 5.

When the construction work in the excavation hole is completed, the hole is back filled with any appropriate material, such as pea gravel, and the various shoring panels are removed in the reverse order in which they were installed. This removal process is considerably easier than the removal process required for soldier beam and lagging shoring. In the latter method, each of the wood slats is under pressure from the walls of the excavation, but this pressure cannot be relieved or equalized by back filling since access must be made to each of the slats. Needless to say, this makes removal of the lagging very difficult. With the present invention, the shoring panels can be easily removed with lines attached to the eyelets 160, and back filling can be employed to equalize the pressure on the panels so that they can be easily removed from the soldier beam channels.

In summary, the present invention provides a hole shoring system which is vastly improved over prior art hole shoring systems or techniques. The system can be quickly and easily installed without the requirement of welding on site or the requirement of positioning workers dangerously in the excavation during installation of the system. The modular construction of the system and the use of double shoring panels enables it to be used for holes of all different sizes and depths. Finally, the shoring system can also be easily and quickly removed once the construction work has been completed.

Although the invention has been disclosed in terms of a preferred embodiment, it will be understood that numerous modifications and variations can be made thereto without departing from the scope of the invention as defined in the following claims.

What is claimed is:

1. A hole shoring system for shoring the peripheral side walls of an excavation hole in the ground comprising:

vertical soldier beams placed in a hole to be shored, said soldier beams being spaced along and abutting corresponding side walls of the hole to be shored and being inserted into the ground at the bottom of the hole, each said soldier beam including a hole-facing front flange, a web and a back flange;

horizontal reinforcing beams disposed at grade level around the periphery of said hole to be shored and parallel to the side walls thereof, said reinforcing beams being attached to back flanges of adjacent soldier beams; and shoring panels disposed between adjacent soldier beams.

2. The hole shoring system of claim 1 wherein each said soldier beam is attached to an adjacent horizontal reinforcing beam by means of a strap which passes through a connector box welded to the back flange of each said soldier beam and is bolted at first and second ends to said adjacent horizontal reinforcing beam.

3. The hole shoring system of claim 1 wherein said plurality of shoring panels includes a front shoring panel for shoring a lower portion of said excavation hole, and a back shoring panel for shoring an upper portion of said excavation hole.

4. The hole shoring system of claim 3 wherein each said soldier beam includes first and second guide beams positioned longitudinally along first and second sides of said web to form front and back channels on each side of said web for guiding said front and back shoring panels, respectively.

5. The hole shoring system of claim 4 wherein each said shoring panel includes a first and second flanged side end for reception in said channels.

6. The hole shoring system of claim 1 wherein at least one flat shoring panel is disposed between each adjacent pair of said soldier beams along each side wall of said hole, and at least one L-shaped vertical cross section shoring panel is disposed adjacent a corner of said excavation hole with a first end of said L-shaped panel positioned between the front and back flanges of one of said soldier beams adjacent a first wall of said excavation hole extending from said corner, and a second end of said L-shaped panel positioned between the front and back flanges of one of said soldier beams adjacent a second wall of said excavation hole extending from said corner.

7. The hole shoring system of claim 1 wherein each said shoring panel includes a steel box frame having first and second steel plates spot welded to front and back sides, respectively, thereof.

8. The hole shoring system of claim 7 wherein each said shoring panel further includes:

an angled cutting blade welded to a bottom of said box frame;

a striker bar forming a top surface of said shoring panel; and a pair of spaced steel eyelets welded at the top of said shoring panel for enabling the panel to be hoisted.

* * * * *